United States Patent [19]

Hsueh et al.

[11] Patent Number: 5,007,094

[45] Date of Patent: Apr. 9, 1991

[54] MULTIPULSE EXCITED POLE-ZERO FILTERING APPROACH FOR NOISE REDUCTION

[75] Inventors: A-Chuan Hsueh, Laguna Niquel, Calif.; Chiu-Kuang Chuang, Lexington, Mass.

[73] Assignee: GTE Products Corporation, Waltham, Mass.

[21] Appl. No.: 335,142

[22] Filed: Apr. 7, 1989

[51] Int. Cl.[5] ..... G10L 5/00

[52] U.S. Cl. ..... 381/47; 381/49

[58] Field of Search ..... 381/47

[56] References Cited

PUBLICATIONS

B. S. Atal and J. R. Remde, "A New Model of LPC Excitation Producing Natural-Sounding Speech at Low Bit Rates", Proc. IEEE Conf. Acoust., Speech & Sig. Proc., 1982, pp. 617-617.

I. M. Trancoso, R. Garcia Gomez, and J. M. Tribolet "A Study on Short-Time Phase and Multipulse LPC", Proc. Int. Conf. Acoust., Speech and Sig. Proc., Mar. 1984, pp. 10.3.1-10.3.4.

I. M. Trancoso, L. B. Almeida and J. M. Tribolet, "Pole-Zero Multiple Speech Representation Using Harmonic Modelling in the Frequency Domain," Proc. Int. Conf. Acoust., Speech and Sig. Proc., 1985, pp. 260-263.

T. F. Quatieri and R. J. McAulay, "Mixed-Phase Deconvolution of Speech".
Based on a Sine-Wave Model, Proc. Int. Conf. Acoust., Speech and Sig. Proc., 1987, pp. 649-652.

K. K. Paliwal, "Speech Enhancement Using Multipulse Excited Linear Prediction System," Proc. Int. Conf. Acoust., Speech and Sig. Proc., 1986, pp. 101-104.

K. J. Astrom, "Maximum Likelihood and Prediction Error Methods" 5th IFAC Symposium on Identification and System Parameter Estimation, 1979.

A. E. Rosenberg, "Effect of Glotal Pulse Shape on the Quality of Natural Vowels", The J. of Acoustical Soc. of America, vol. 49, No. 2, 1971, pp. 583-590.

*Primary Examiner*—Emanuel S. Kemeny

*Attorney, Agent, or Firm*—Hamilton, Brook, Smith & Reynolds

[57] ABSTRACT

A pulse train of primary pulses is estimated from an inverse LPC analysis of a frame of voiced speech. From this estimated pulse train a pole-zero filter is estimated. The estimated pulse train is used to excite the estimated pole-zero filter to produce a synthesized speech signal. The synthesized speech signal is compared to the original frame of speech to determine the error in the original speech signal. Both the pulse amplitude and filter are adjusted to compensate for the error and another synthesized speech signal is produced. The process may be repeated until the synthesized speech signal and original speech signal converge.

31 Claims, 5 Drawing Sheets

MULTIPULSE EXCITED POLE-ZERO FILTERING APPROACH FOR NOISE REDUCTION

RELATED REFERENCES

The subject matter of this invention discussed by A Chuan Hseuh and C. K. Chuang. "A Multipulse Excited Pole-Zero Filtering Approach for Speech Enhancement," Proc. IEEE Conf. Acoust, Speech and Signal Proc., pp. 505-548, New York, N.Y. (April, 1988).

BACKGROUND OF THE INVENTION

Speech is traditionally modeled in a manner that mimics the human vocal tract. Such traditional models view speech as originating from two excitation signals: a voiced speech excitation signal and an unvoiced excitation speech signal. These two excitation signals can be convolved by a filter to produce a resulting synthesized speech signal. FIG. 1 illustrates synthesis in the traditional speech model. The voice excitation signal 12 and unvoiced excitation signal 14 are applied to a LPC filter 10 to produce synthetic speech 16.

For the purposes of convenience, models of speech analysis and synthesis are generally represented as mathematical formulas. In particular, the voiced excitation signal, the unvoiced excitation signal, and the resulting speech signal are often each represented as series of time varying samples of their respective analog waveforms. The filter in turn, is viewed as a transform that operates upon the series of samples. A frequency domain representation of the filter can be obtained by using a z transform When such a z transform is employed, the filter can usually be represented as a transfer function, H(z) This transfer function equals the z transform of the output signal, Y(z), divided by the z transform of the input signal, X(z) In equation form, the transfer function can be represented as $$H(z)=Y(z)/X(z)$$

where $Y(z)=z$ transform of the output signal;

$X(z)=z$ transform of the input signal.

The z transform of the input signal and the z transform of the output signal can be represented as polynomials. The resulting transfer function H(z) can be represented as the product of factors of polynomials. In particular, when so represented $$H(z)=\frac{\prod_{k=1}^{M}(1-c_k z^{-1})}{\prod_{k=1}^{N}(1-d_k z^{-1})}$$

where M,N=lengths of the respective sequences;

The roots of the factors of the numerator are known as zeroes, and the roots of the factors of the denominator are known as poles Filters may be used to obtain a parametric representation of the speech signal, as opposed to a representation that attempts to duplicate the analog waveform of the speech signal. Linear Predictive Coding (LPC) is one technique of obtaining such a parametric representation. LPC speech synthesis as originally devised sought to operate on two separate excitation signals. The first excitation signal represented the voiced speech component and had only a single pulse per every pitch period. The other excitation signal represented unvoiced speech and was not limited with regard to number of pulses per pitch period. In fact, the second unvoiced excitation signal typically had several pulses per a pitch period.

One of the primary difficulties with the traditional single pulse model for LPC when applied to voiced speech was that it made a simplified assumption that there is only one pulse per pitch period in voiced speech. It is, however, known that there is generally secondary excitation per pitch period in voiced speech. The resulting synthesized speech from filters devised under this traditional model have proven to be unnatural sounding because of the inaccuracy of the model. In response to this problem. Atal and Remde proposed an LPC model that (operated on multiple pulses of speech per pitch period that accounted for the secondary excitation. This model has become known as the multipulse model.

The multipulse model makes no a priori assumption about the nature of the excitation signal. Each frame of speech is modeled by its LPC filter and a fixed number of pulses. As a result, a critical estimate of the pitch period of the excitation signal is no longer necessary as required in the single model. The result of Atal and Remde's innovation has been a model and filters that produce more natural sounding speech.

The multipulse model has typically employed an all-poles LPC filter. Such a filter, however, performs poorly when the modeled voiced segment is a mixture of minimum and non-minimum phase characteristics. In order to attempt to remedy this problem, pole-zero filters have been substituted for the all-poles LPC filters.

SUMMARY OF THE INVENTION

In accordance with one aspect of the present invention, a method for encoding speech includes estimating an excitation pulse train from an original speech signal. Once the pulse train is estimated, a pole-zero filter is modified. The estimated pulse train is applied to the pole-zero filter to synthesize a speech signal. The estimate of the pole-zero filter is modified based on the error between the original speech signal and the synthesized speech signal.

In the preferred embodiment of the present invention, a method of speech enhancement is disclosed. In particular a pulse train is extracted from a Linear Predictive Coding residual. The residual was derived from an original speech signal. Once the pulse train is extracted, a best filter is found using a prediction error identification technique. This filter is preferably a pole-zero filter. Subsequently, secondary pulses are extracted from the residual. The periodic impulse train and the secondary pulses are used to excite the best filter to produce a clean speech signal.

The step of extracting the periodic pulse train preferably includes squaring the residual signal and then identifying a largest peak on this squared residual signal. After the largest peak is identified, peaks are detected that are larger than a chosen threshold relative to the largest peak. Once these steps are completed, pulses are located using a trace-back procedure that identifies the pitch pulse by examining a small sample of pulses near the largest pulse of an estimated pitch period.

In order to find a best filter, the amplitude of the pulses is estimated, and the best filter is estimated. The estimated pulse amplitudes are used to excite the best filter estimate to produce a synthesized speech signal. A prediction error identification technique is applied to determine the amount of error between the synthesized speech signal and the original speech signal. The magnitude of this error is used to determine if a convergence has occurred between the original speech signal and synthesized speech signal. If there is no convergence, the amplitude estimate and best filter estimate are updated to minimize the amount of error. On the other hand, if there is a convergence, the best filter estimate becomes the best filter.

The present invention also includes the step of extracting the secondary pulses. The secondary pulses are preferably extracted by using a multipulse pole-zero technique. The best filter should be a mixed phase filter so as to not limit the potential usefulness of the filter.

In accordance with another aspect of the present invention, the original speech signal is filtered through an LPC filter to produce a residual signal. The LPC filter is an inverse all-poles filter. The resulting residual signal from this filter is comprised of both voiced components and unvoiced components. This residual signal is processed as previously described.

BRIEF DESCRIPTION OF THE DRAWINGS

The foregoing and other objects, features and advantages of the invention will be apparent from the following more particular description of the preferred embodiment of the invention, as illustrated in the accompanying drawings.

DETAILED DESCRIPTION OF THE PREFERRED EMBODIMENT

Figure 1:
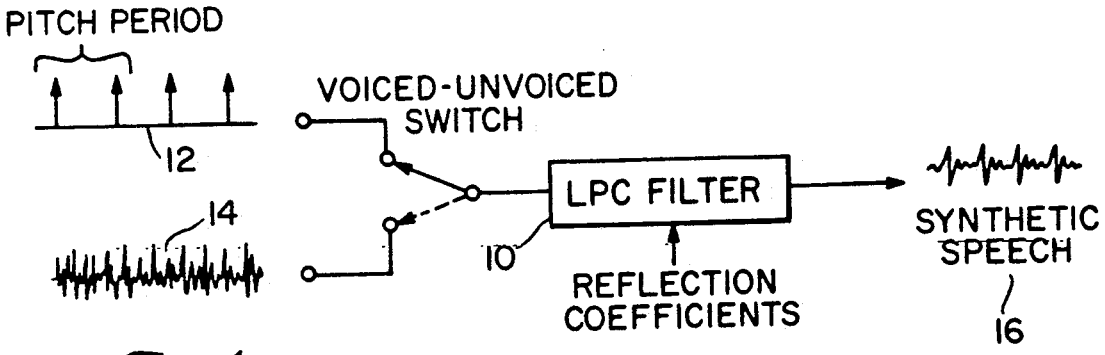
Fig. 1 Prior Art
FIG. 1 illustrates the traditional single pulse model of speech.

In the preferred embodiment of the present invention, a voiced speech signal 27 enters a telephone line. Typically, this speech signal 27 originates from a human voice directed into a telephone receiver. The incoming speech signal 27 enters a sampler 8 wherein the speech signal 27 is sampled to produce a frame of sampled speech 28. The sampled frame of speech then enters a processor means 24 containing an all-poles Linear Predictive Coding (LPC) analysis unit 20. The analysis unit 20 is used to estimate the pulse train of the frame of sampled speech. An all-poles analysis unit 20 is specified as a matter of convenience.

In response to the incoming frame of speech 28, the all-poles LPC analysis unit 20 performs LPC analysis (Step 32 in FIG. 3) which produces a residual signal 26 containing both primary and secondary pulses as well as LPC coefficients 25. The processor means performs pole-zero multipulse analysis 22 on the residual signal 26 and LPC coefficients. Specifically, the processor means 24 examines the residual signal 26 and locates the primary pulses contained therein (Step 33). This procedure accurately extracts the location of the true primary pitch pulses.

Figure 4:
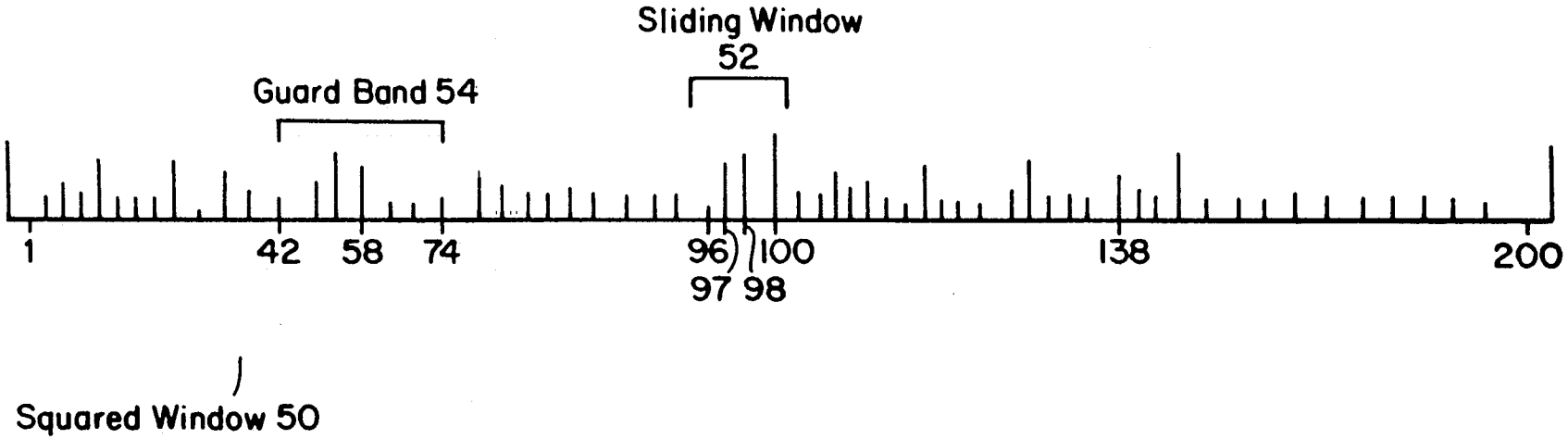
FIG. 4 illustrates the windows utilized in the trace-back procedure.
Figure 5:
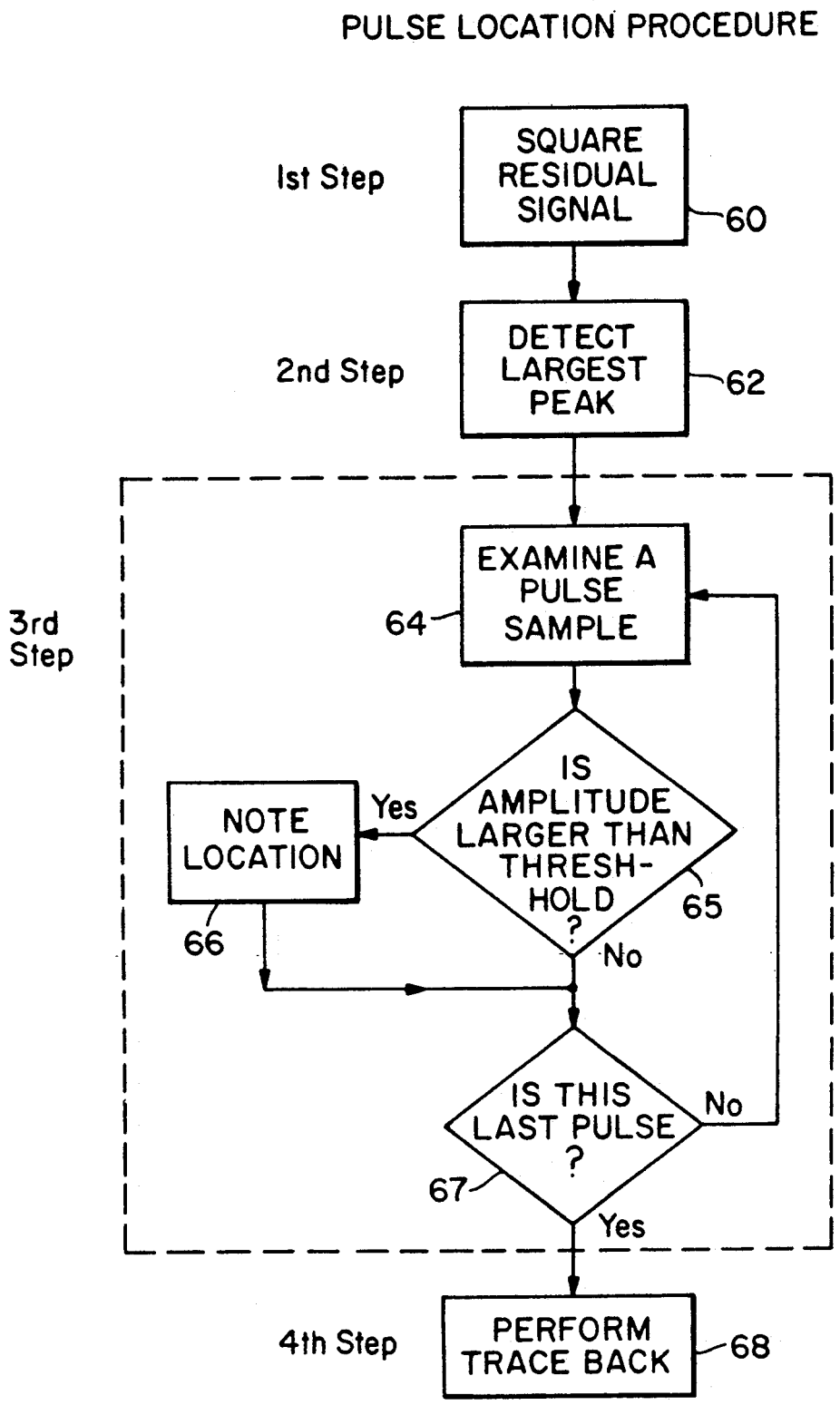
FIG. 5 illustrates a flow chart of the pitch pulse location procedure.

This process of locating the pulses has four steps as shown in FIG. 5. First, the residual signal 26 produced from the original frame of speech 28 is rectangular resulting in a squared window of pulse samples (Step 60. FIG. 5). Typically this rectangular window 50 is composed of roughly 200 samples (See FIG. 4). Second, the largest peak in the squared sample is identified (Step 62). Third, the largest peak is used as a reference of comparison for the other peaks in the rectangular window 50. In particular, the processor means 24 examines a pulse (Step 64) in the rectangular window 50 (FIG. 4) and compares it with a threshold value set as a percentage of the largest peak to determine if it is larger than the threshold (Step 65). The threshold value is generally between 40% to 50% of the largest peak. If the pulse is greater than the threshold value, it is noted (Step 66), for it is most likely not unwanted noise. The processor means 24 then checks if the pulse just examined was the last pulse (Step 67) in the rectangular window 50. If not, it examines the next pulse, and otherwise, it goes on to the next step in locating the pitch pulses.

Figure 6:
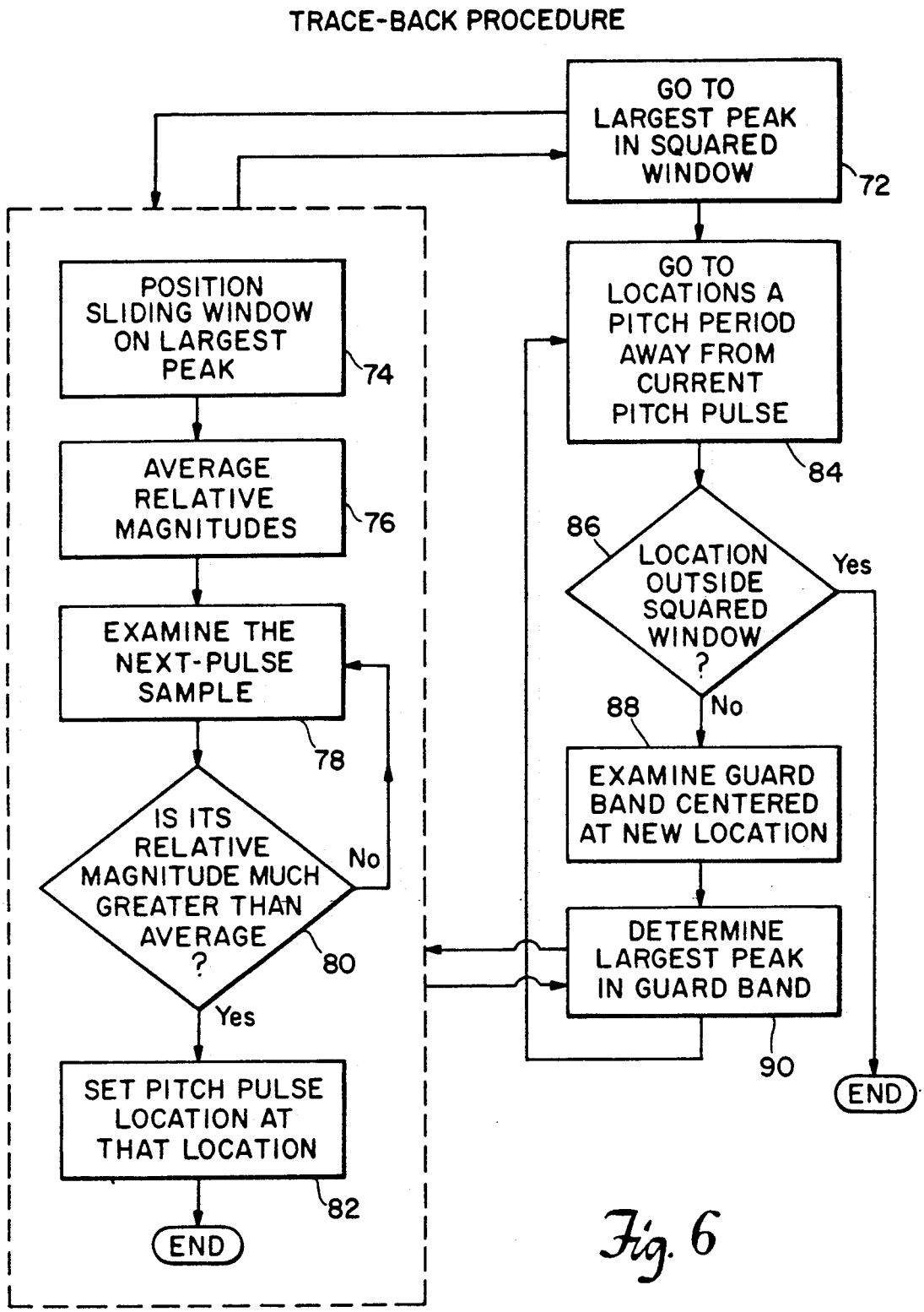
FIG. 6 illustrates a flow chart of the trace back procedure.

After the pulses which exceed the threshold are noted, the fourth step in the process is performed. Specifically, a trace-back procedure (Step 68) is used to determine the locations of the pitch pulses in the rectangular window 50. FIG. 6 shows a flow chart of the trace-back procedure. The starting point for the trace-back procedure is the location of the previously identified largest peak (Step 72 in FIG. 6). A sliding window 52 of 3 to 5 samples for examining pulses is set at the location of the largest peak (Step 74). The window 52 covers a fixed number of samples (typically 3 to 5 samples) that precede the largest peak, but does not include the actual largest peak.

Having set the sliding window 52 at the proper location the processor means 24 determines the average magnitude relative to the largest peak of the pulse samples in the sliding window 52 (Step 76). It does this by determining the relative magnitude of each pulse sample, summing these relative magnitudes and dividing the sum by the number of samples in the window.

Once the average relative magnitude is calculated, the processor means 24 examines the pulse sample that immediately proceeds the largest peak sample (Step 78). It compares the relative magnitude of this pulse sample with the average relative magnitude (Step 80). The processor means 24 then does the same comparison with the pulse sample that precedes the previously compared pulse sample (i.e. repeats Step 78). It continues performing such comparisons until the relative magnitude of the compared pulse sample is much greater than the average relative magnitude. This pulse sample whose relative magnitude is much greater than the average relative magnitude is the pitch pulse location estimate (Step 82).

Having found the location of a first pitch pulse, the processor means 24 seeks to locate the other pitch pulses. To do this, the processor means 24 relies on the pitch estimate produced by inverse all-poles LPC analysis unit 20. It examines the pulse sample locations that are in a window about a pitch period away from the first located pitch pulse (Step 84). For example, if the pitch estimate derived from the LPC analysis unit 20 is 40 samples and the first pitch pulse is located at sample 98 of the approximately 200 samples in the rectangular window, the processor means 24 then positions itself at sample 58 or sample 138. The order is irrelevant so long as both locations are eventually examined.

Suppose for illustrative purposes that the processor means 24 positions itself at sample 58. It first checks whether the new location is outside the rectangular window (Step 86). If it is not outside, the processor means continues processing. In this case it would continue processing. Experience with LPC analysis suggests that the pitch pulse is located near location 58 and at the very least is within an 80% of pitch period guard-band 54 (approximately 32 samples in this case) centered at position 58. In other words, the pitch pulse can only be located between pulse sample locations 78 and 42. This guard-band 54 is then examined to determine the largest peak in the guard-band (Step 88). Once the largest peak is located (Step 90). the sliding window is positioned at that location as previously described regarding the largest peak in the entire rectangular window. The trace-back procedure is then employed for this window position.

After the pitch pulse near position location 58 has been located, location 138 is examined. Subsequently, after the pitch pulse locations near 58 and 138 are determined, the locations a pitch away are examined. The previously described steps are repeated at those locations.

It should be noted that if the guard-band 54 points to a sample location outside the rectangular window 50, the processor means 24 merely ignores those locations in the guard-band 54 outside the rectangular window. It looks only at those locations within the guard-band 54 that are within the rectangular window 50. For instance, if the processor means 24 is located at location 9 and the pitch is 40, the processor means 24 only looks at locations 1 through 25. Furthermore, once the processor means 24 has examined both ends of the rectangular window 50 it has estimated all the pitch pulse locations with the rectangular window 50, and it moves on to the next step in processing.

The processor means 24 applies a cross-frame consistency check to eliminate potentially spurious signals that often appear near the first end of the rectangular window 50. In particular, it looks to the pitch pulse located closest to the beginning of the rectangular window 50. If this pitch pulse is within roughly an 80% of pitch period of the pitch pulse closest to the end of the last processed rectangular window 50, it discards the pulse located near the beginning of the current rectangular window 50. In this manner, it eliminates the potentially spurious pulse. The above-described heuristic approach obtains a good estimate of the pitch pulse locations and is robust even with a noisy residual signal 26.

Figure 3:
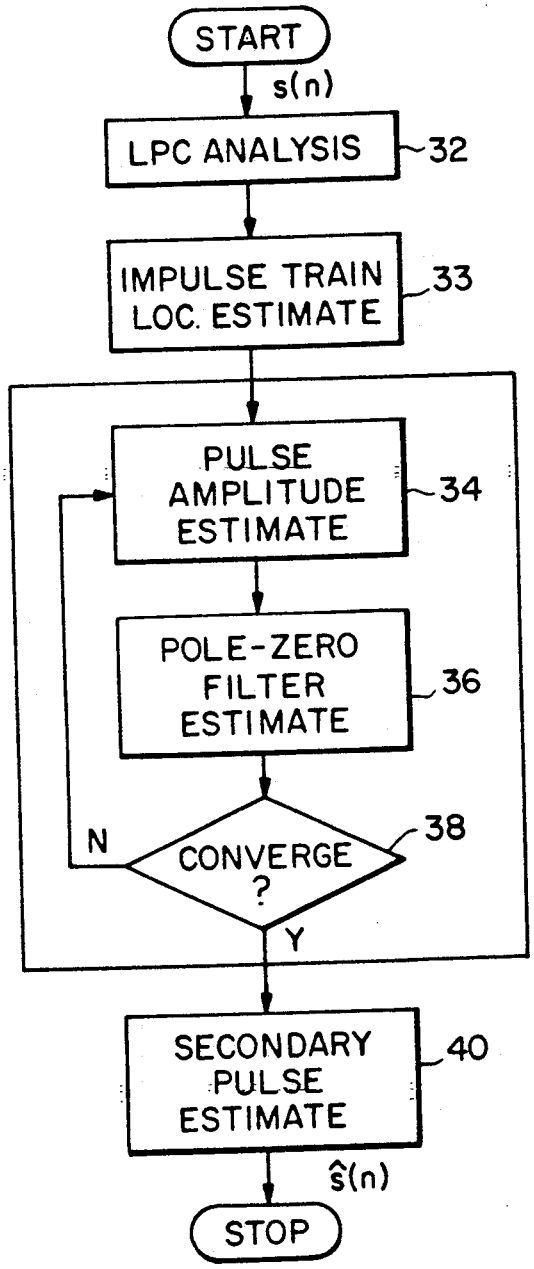
FIG. 3 illustrates a flow chart that describes the steps involved in noise reduction int he present invention.
Figure 2:
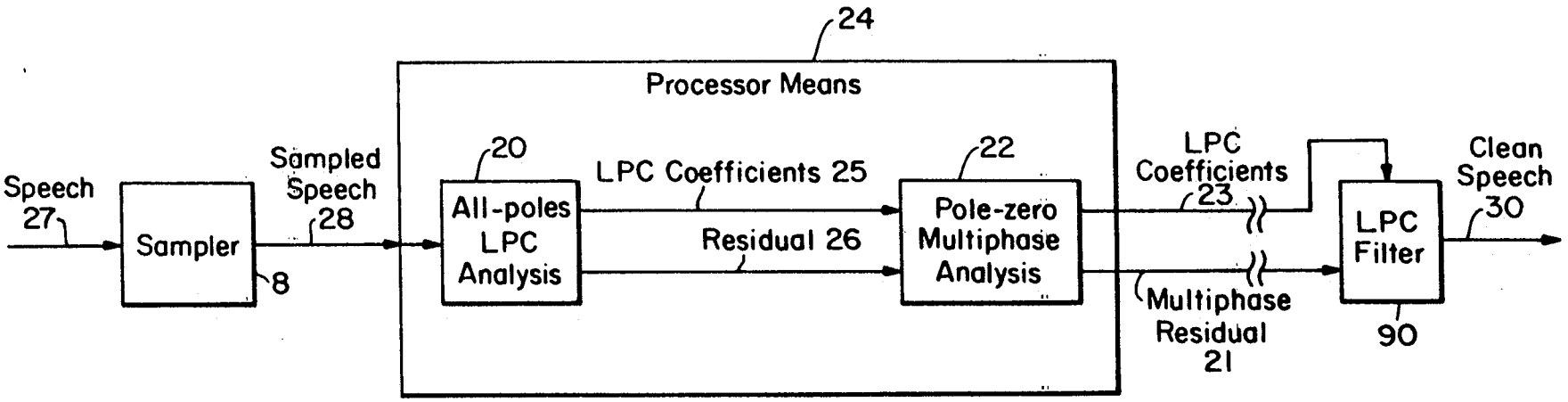
FIG. 2 illustrates the noise reduction system employed in the present invention.

Having located the major pulses in the residual 26, the processor means 24 has completed Step 32 in FIG. 3 and begins the iterative part of the noise reduction procedure. First, the amplitudes of the located pulses are estimated. Each pulse is processed individually, and the pulse's contribution to the residual 26 is removed before processing the next pulse. The pulse amplitude $V_i$ is calculated as the normalized cross-correlation between the system impulse response h(K) and an error singal $e_i$(K) using the following equation $$V_i = \frac{\sum^{N} e_{i-1}(K)\, h(K - K_i)}{\sum^{N} h^2(K - K_i)}$$

where $V_i$=the pulse amplitude at location $K_i$;

$e_i(K)$=the error at location $K_i$ and $h(K)$=the system impulse response at location K.

The error $e_i$(K) at location $K_i$ is computed utilizing the following equation:

$$e_i(K) = e_{i-1}(K) - V_i * h(K - K_i)$$

given $$e_0(K) = s(K)$$

where $s(K)$=the noisy frame of speech; and
*=convolution.

The amplitudes are estimated utilizing a technique such as discussed in I. M. Trancoso, R. Garcia-Gomez, and J. M. Tribolet, "A Study on Short Time Phase and MultiPulse LPC." *Proc. Int. Conf. Acoust., Speech and Signal Proc.*, pp 10.3.1–10.3.4, San Diego, Calif. (March, 1984).

When the processor means 24 has completed the first estimation of the amplitude of the pitch pulses (Step 34), it then estimates a best pole-zero filter (Step 36) for the extracted pulse train to produce a clean output speech signal. For the first iteration, the pulse amplitudes are estimated using a minimum phase impulse response. A prediction error method (PEM) as described in K. J. Astrom, "Maximum Likelihood and Prediction Error Methods," Presented at the 5th IFAC Symposium on Identification and System Parameter Estimation. F. R. Germany (September, 1979) and D. M. Marquardt. "An Algorithm for Least Squared Estimation of Nonlinear Parameters," *Journal Soc. Indust. Appl. Math.* Vol. 11, pp 431–441, (1963) is then used to adjust the filter parameters to devise a best-pole-zero filter that minimizes the error between the original and synthesized speech signal. The speech signal resulting from exciting the best pole-zero filter estimate with the pulse train of the estimated amplitudes at the extracted locations is compared to the original frame of speech. The error between the two is calculated to determine if there is a convergence between the two (Step 38). The above description of determining the best pole-zero filter can perhaps best be expressed mathematically. In particular, the noisy speech signal 28 can be represented as $$S(K) = h_\theta(K) * U(K) + N(K)$$

where

*=convolution;

$N(K)$=white noise;

$U(K)$=estimated pulse sequence;

$h\theta(K)$=the system impulse response.

Given this equation for the original speech signal, s(K) 28, the pole-zero model for $h\theta$(K) can be characterized by its transfer function. The transfer function can be written as $$H_\theta(Z) = \frac{\sum_{i=0}^{P-1} \beta_i z^{-i}}{1 + \sum_{i=1}^{P} \alpha_i z^{-i}}$$

where $$\theta = \{\alpha_i, \beta_{i-1} \mid i = 1, P\}$$

The unknown variable $\theta$ is what must be adjusted to adjust filter parameters (coefficients a and b) so as to minimize the error between the original speech signal and the synthesized speech signal.

The error function $J(\theta)$ is defined $$J(\theta) = \sum^{N} (s(K) - h_\theta(K) * U(K))^2$$

The prediction error method referenced above is used to obtain a $\theta$ that minimizes the above-described error. This new $\theta$ is used to obtain new filter parameters. The estimated amplitudes are used to excite the adjusted filter, and it is checked whether the synthesized signal and the sample frame of speech converge. If they do not converge, the process is repeated until a convergence occurs.

The convergence indicates that the pole-zero filter estimate is indeed the best pole-zero filter for the sampled frame of speech 28. Having already extracted the major pulses of this signal, the processor means 24 begins to extract the secondary pulses of this signal (Step 40). The extraction of the secondary pulses is quite straightforward. A multipulse technique such as proposed in B. S. Atal and J. R. Remde, "A New Model for LPC Excitation Producing Natural-Sounding Speech at Low Bit Rates "*Proc. IEEE Int Conf Acoust., Speech and Signal Procs.*, pp. 614–617, Paris, France (1988) is applied that utilizes the best pole-zero filter estimate obtained in the previous step.

The generated coefficients $\alpha$ and $\beta$ 23 which define the pole-zero filter, and the locations and amplitudes which define the multipulse residual signal 21, are then transmitted to an LPC filter 90. At the filter, the clean speech 30 is produced simply by convolving the pitch pulse estimates and the secondary pulse estimates through the LPC filter 90 constructed from the coefficients. As a result, one can hear a speech signal at the receiving end of a system that is comparable to the incoming speech signal 28 originating from the transmitting end.

While the invention has been particularly shown and described with reference to preferred embodiments thereof, it will be understood by those skilled in the art that various changes in form and details may be made without departing from the spirit and scope of the invention as defined in the appended claims.

We claim:

1. A method of encoding speech comprising;

estimating an excitation pulse train from an original speech signal;

estimating a pole-zero filter;

applying the excitation pulse train to the estimated pole-zero filter to synthesize a speech signal; and modifying coefficients of the pole-zone filter based on an error between the original speech signal and the synthesized speech signal.

2. A method as claimed in claim 1 wherein the step of estimating an excitation pulse train results in a train of only primary pulses which are of nonconstant pitch.

3. A method as claimed in claim 1 wherein the step of estimating an excitation pulse train comprises performing a linear predictive coding (LPC) analysis and detecting peaks above a threshold in a residual signal obtained from the LPC analysis.

4. A method as claimed in claim 3 wherein the step of estimating the excitation pulse train further comprises a procedure to locate pitch pulses by examining a small sample of pulses near a largest pulse of an estimated pitch period.

5. A method as claimed in claim 3 further comprising the step of modifying amplitudes of the pulse train based on the error between the original speech signal and the synthesized speech signal.

6. A method as claimed in claim 5 further comprising the step of extracting secondary pulses using the pole-zero filter obtained in the step of modifying the estimate of the pole-zero filter.

7. A method as claimed in claim 1 further comprising the step of modifying amplitudes of the pulse train based on the error between the original speech signal and the synthesized speech signal.

8. A method as claimed in claim 1 further comprising the step of extracting secondary pulses using the pole-zero filter obtained in the step of modifying the estimate of the pole-zero filter.

9. A method of encoding speech comprising:

estimating an excitation pulse train from an original speech signal such that the pulse train is of nonconstant pitch, said estimating step comprising performing a linear predictive coding (LPC) analysis and detecting peaks above a threshold in a residual signal obtained from the LPC analysis; and estimating a pole-zero filter to which the excitation pulse train may be applied to synthesize a speech signal simulating the original speech signal.

10. A method of encoding speech comprising:

(a) providing an estimated excitation pulse train from an original speech signal using LPC analysis such that the LPC analysis produces estimated pitch periods for the excitation pulse train;

(b) locating largest pulses within the estimated pitch periods of the excitation pulse train;

(c) for each estimated pitch period, comparing amplitudes of pulses located near the largest pulse of the pitch period to locate a pitch pulse that is encoded as the pitch pulse for the pitch period.

11. A method as claimed in claim 10 wherein the step of estimating the excitation pulse train comprises a procedure to detect significant change in prediction error when multiple peaks surround a pitch pulse.

12. A method of noise reduction for speech processing comprising the steps of:

a. performing Linear Predictive Coding (LPC) analysis on an original speech signal to produce a residual signal;

b. extracting a pulse train from the residual signal;

c. finding best pole-zero filter using a prediction error identification technique that selects a best set of coefficients for the filter;

d. extracting secondary pulses from the residual signal; and e. convolving the pulse train and the secondary pulses via the best pole-zero filter to produce a clean speech signal.

13. A method as recited in claim 12 wherein the step of extracting the pulse train locations comprises:
a. squaring the residual signal;
b. identifying a largest peak of the squared residual signal;
c. detecting peaks of the squared residual signal that are larger than a threshold relative to a largest peak; and
d. locating pulses by a procedure that extracts pitch pulses.

14. A method as recited in claim 12 wherein the step of finding a best pole-zero filter comprises:
a. estimating amplitudes of pulses in the pulse train;
b. estimating the best pole-zero filter for the pulses and exciting the best pole-zero filter estimate with the estimated pulses to produce a synthesized signal;
c. determining an amount of error between the synthesized speech signal and the original speech signal;
d. determining if there is a convergence between the original speech signal and the synthesized speech signal based on the amount of error;
e. if there is no convergence,
updating the best pole-zero filter estimate to minimize the amount of error by altering the coefficients of the filter;
repeating steps b through e; and
f. if there is a convergence, denoting the best pole-zero filter estimate as the best pole-zero filter.

15. A method as recited in claim 12 wherein the step of extracting secondary pulses comprises employing a multipulse technique using the best pole-zero filter to extract secondary pulses.

16. A method of noise reduction for speech processing comprising the steps of:
a. filtering an original speech signal through an all-poles Linear Predictive Coding (LPC) filter to produce a residual signal;
b. extracting a pulse train form the residual signal by:
squaring the residual signal; identifying a largest peak of the squared residual signal;
detecting peaks of the squared residual signal that are larger than a threshold relative to the largest peak;
c. finding a best pole-zero mixed phase filter by:
estimating amplitudes of pulses in the pulse train;
estimating the best pole-zero filter by selecting a set of coefficients and exciting the best pole-zero filter estimate with the estimated pulse amplitudes to produce a synthesized speech signal;
applying a prediction error identification technique to determine an amount of error between the synthesized speech signal and the original speech signal;
determining if there is a convergence between the original speech signal and the synthesized speech signal based on the amount of error;
if there is no convergence, repeating steps b through e;
if there is a convergence,
denoting the best pole-zero filter estimate as the best pole-zero filter;
d. extracting secondary pulses from the residual signal by employing a multipulse technique that uses the best pole-zero filter to extract the secondary pulses; and
e. convolving the the pulse train and the secondary pulses via the best pole-zero filter to produce a clean speech signal.

17. A method of determining a best pole-zero filter to accurately model an original speech signal from a pulse train extracted out of a Linear Predictive Coding (LPC) residual signal, comprising the steps of:
a. estimating amplitudes of pulses in the pulse train;
b. estimating the best pole-zero filter by selecting a set of coefficients for the filter and exciting the best pole-zero filter estimate with the estimated pulse amplitudes to produce a synthesized signal;
c. determining an amount of error between the synthesized speech signal and the original speech signal;
d. determining if there is a convergence between the original speech signal and the synthesized speech signal based on the amount of error;
e. if there is no convergence,
updating the best pole-zero filter estimate to minimize the amount of error;
repeating steps b through e; and
f. if there is a convergence, denoting the best pole-zero filter estimate as the best pole-zero filter.

18. A procedure for locating pitch pulses in a multipulse set of pulse samples comprising the steps of:
a. placing a small window that views pulse samples immediately preceding a largest detected peak in the set of pulse samples;
b. computing an average relative magnitude of the pulses in the window relative to the largest peak;
c. comparing the magnitude of each pulse sample in the window to the average relative magnitude;
d. designating the pulse sample whose relative magnitude is much greater than the average relative magnitude as the pitch pulse;
e. moving the small window to a next pulse sample; and
f. repeating steps a–e until all samples in the set of samples have been examined.

19. A method as recited in claim 18 wherein the step of moving to a next pulse sample comprises:
obtaining a pitch period estimate from an LPC analysis of the set of pulse samples;
moving to a location a pitch period away from the previously found pitch pulse location;
examining a guard-band centered at the location a pitch period away to find the largest pulse in the guard-band; and
placing the small window immediately proceeding the largest pulse in the guard-band.

20. A method as recited in claim 19 wherein the guard-band cover those pulse samples within a large percentage of the pitch period.

21. A speech enhancement system comprising a processor means; wherein the processor means comprises
a. an inverse all-poles Linear Predictive Coding (LPC) analysis unit for producing residual signals from incoming multipulse frames of speech;
b. a best pole-zero mixed-phase filter for producing clean speech signals from the residual signals;
wherein the incoming multipulse frames of speech enter the inverse all-poles LPC filter to produce residual signals that are processed by the processor means which updates the best pole-zero mixed-phase filter so that the filter may filter the residual signals to produce clean speech signals.

22. The system of claim 18 wherein the system is employed in telephone lines.

23. A method of encoding speech comprising:

estimating an excitation pulse train from an original speech signal;

estimating a pole-zero filter by selecting a set of coefficients for the filter;

modifying the estimate of the excitation pulse train and the estimate of the pole-zero filter to minimize the expected error between the original speech signal and a speech signal to be synthesized when the excitation pulse train is applied to the estimated pole-zero filter.

24. A method as recited in claim 23 wherein the step of estimating an excitation pulse train results in a train of only primary pulses which are of nonconstant pitch.

25. A method as recited in claim 23 wherein the step of estimating the excitation pulse train further comprises a procedure to locate pitch pulses by examining a small sample of pulses near a largest pulse of an estimated pitch period.

26. A method as recited in claim 23 wherein the step of modifying the estimate of the excitation pulse train comprises modifying the amplitudes of the excitation pulse train.

27. A method of encoding speech comprising the steps of:

estimating an excitation pulse train having primary pulses of non-constant pitch from an original speech signal;

estimating a pole-zero filter by selecting a set of coefficients for the filter;

modifying the estimate of the excitation pulse train by modifying the amplitudes of the excitation pulse train and modifying the estimate of the pole-zero filter to minimize the expected error between the original speech signal and a speech signal to be synthesized when the excitation pulse train is applied to the estimated pole-zero filter.

28. A method as recited in claim 27 further comprising the step of applying the excitation pulse train to the estimated pole-zero filter to synthesize a speech signal.

29. A method of encoding speech comprising the steps of:

estimating an excitation pulse train from the original speech signal;

estimating a pole-zero filter by selecting a set of coefficients for the filter;

applying the excitation pulse train to the estimated pole-zero filter to synthesize a speech signal; and modifying an estimate of the excitation pulse train and the estimate of the pole-zero filter based on an error between the original speech signal and the synthesized speech signal.

30. A method as recited in claim 29 wherein the step of estimating an excitation pulse train results in a train of only primary pulses which are of non-constant pitch.

31. A method as recited in claim 30 further comprising the step of modifying amplitudes of the pulse train based on teh error between the original speech signal and the syntehsized speech signal.

* * * * *

UNITED STATES PATENT AND TRADEMARK OFFICE

CERTIFICATE OF CORRECTION

PATENT NO. : 5,007,094

DATED : April 9, 1991

INVENTOR(S) : A-Chuan Hsueh and Chiu-Kuang Chuang

It is certified that error appears in the above-identified patent and that said Letters Patent is hereby corrected as shown below:

Title Page:

Change name of Assignee from "GTE Products Corporation" to --GTE Laboratories Incorporated--.

Claim 1, line 60, column 7, change ";" to --:--;

Claim 1, line 66, column 7, change "pole-zone" to --pole-zero--.

Claim 11, line 51, column 8, this claim should depend on claim 9, therefore change "10" to --9--.

Claim 12, line 61, column 8, insert "a" before "best".

Claim 16, line 1, column 10, change "the the pulse" to --the pulse--.

Signed and Sealed this

Twenty-second Day of September, 1992

*Attest:*

DOUGLAS B. COMER

*Attesting Officer*

*Acting Commissioner of Patents and Trademarks*